US009911568B2

(12) United States Patent
Heid

(10) Patent No.: US 9,911,568 B2
(45) Date of Patent: Mar. 6, 2018

(54) METAL-JET X-RAY TUBE

(71) Applicant: Oliver Heid, Erlangen (DE)

(72) Inventor: Oliver Heid, Erlangen (DE)

(73) Assignee: Siems Aktiengesellschaft, Müchen (DE)

( * ) Notice: Subject to any disclaimer, the term of this patent is extended or adjusted under 35 U.S.C. 154(b) by 120 days.

(21) Appl. No.: 14/978,475

(22) Filed: Dec. 22, 2015

(65) Prior Publication Data

US 2016/0189910 A1 Jun. 30, 2016

(30) Foreign Application Priority Data

Dec. 22, 2014 (DE) ..... 10 2014 226 814

(51) Int. Cl.

| | |
|---|---|
| ***H01J 35/00*** | (2006.01) |
| ***H01J 35/08*** | (2006.01) |
| ***H01J 35/06*** | (2006.01) |
| ***H01J 1/16*** | (2006.01) |
| ***H05G 2/00*** | (2006.01) |

(52) U.S. Cl.

CPC ..... *H01J 35/08* (2013.01); *H01J 1/16* (2013.01); *H01J 35/06* (2013.01); *H05G 2/005* (2013.01)

(58) Field of Classification Search

CPC ..... H01J 1/16; H01J 35/06; H01J 2235/082; H01J 2235/086; H01J 35/08; H01J 2235/06; H01J 2235/062; H01J 2235/1225; H01J 2235/168; H01J 35/065; H01J 35/12; H01J 35/16; H01J 35/18; H05G 2/005; A61B 6/4035

USPC ..... 378/119, 121, 174, 137, 138, 143

See application file for complete search history.

(56) References Cited

U.S. PATENT DOCUMENTS

| | | | | |
|---|---|---|---|---|
| 5,773,921 | A * | 6/1998 | Keesmann | H01J 1/3042 313/309 |
| 7,929,667 | B1 * | 4/2011 | Zhuang | H05G 2/003 378/119 |
| 2002/0015473 | A1 | 2/2002 | Hertz et al. | |
| 2016/0120012 | A1 | 4/2016 | Heid | |

FOREIGN PATENT DOCUMENTS

| | | | |
|---|---|---|---|
| CN | 1272989 | C | 8/2006 |
| DE | 102013209447 | A1 | 11/2014 |
| DE | 102013220189 | A1 | 4/2015 |

(Continued)

OTHER PUBLICATIONS

Chinese Office Action for Chinese Patent Application No. 201511036045.5 dated Mar. 3, 2017, with English Translation.

(Continued)

*Primary Examiner* — Irakli Kiknadze

(74) *Attorney, Agent, or Firm* — Lempia Summerfield Katz LLC

(57) ABSTRACT

A metal jet x-ray tube is proposed, that is affected less than conventional tubes by the problem of the power density at the point of incidence of the electron beam on the anode component. To this end, the metal jet x-ray tube provides a metal jet as an anode component that is so thin that this metal jet only partly decelerates an electron beam incident thereon. Moreover, the metal jet of the anode component is at least embedded or dissolved in a single second material that passes electrons relatively well and is heat absorbing.

18 Claims, 2 Drawing Sheets

(56) References Cited

FOREIGN PATENT DOCUMENTS

Figure 1:
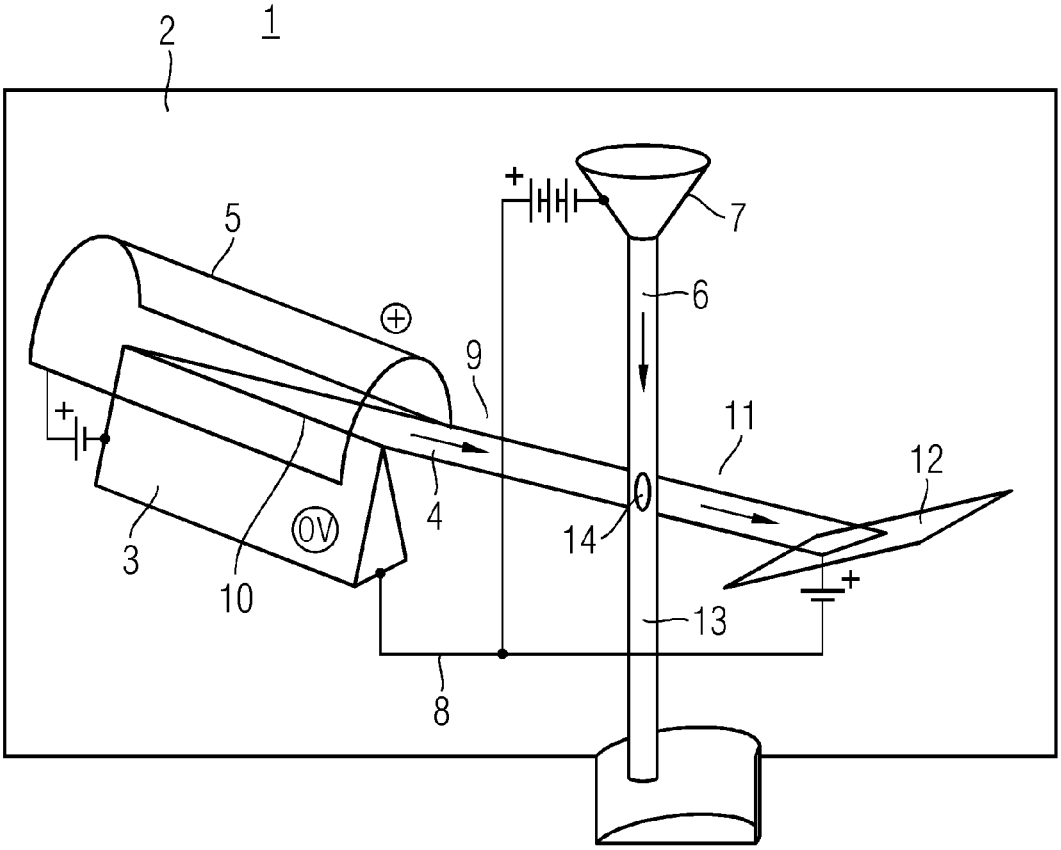

| | | | |
|---|---|---|---|
| EP | 1305984 | B1 | 11/2010 |
| WO | WO0131678 | A1 | 5/2001 |
| WO | WO2014187586 | A1 | 11/2014 |

OTHER PUBLICATIONS

Hemberg, Oscar, Mikael Otendal, and Hans M. Hertz. "Liquid-metal-jet anode x-ray tube." Biomedical and X-Ray Physics. vol. 5196 (2004): 421-431.

German Search Report for related German Application No. 10 2014 226 814.1, dated Aug. 13, 2015, with English Translation.

* cited by examiner

METAL-JET X-RAY TUBE

This application claims the benefit of DE 102014226814.1, filed on Dec. 22, 2014, which is hereby incorporated by reference in its entirety.

FIELD

The invention relates to a metal jet x-ray tube in accordance with the preamble of claim 1.

BACKGROUND

In stationary or rotary anode tubes, or else metal jet x-ray tubes, there is the problem of the power density at the point of incidence of the electron beam on the anode component. There, too high power losses are generated for given luminous intensities and focal spot luminances. Moreover, strong background magnetic fields, for example caused in conjunction with magnetic resonance imaging scanners, cause a problem. It is impossible to electrostatically focus the electron beam in magnetic fields of such strength.

The problem of maintaining the solid or liquid aggregate state of the anode material in the focal point of the electron beam in rotation anode tubes and in metal jet x-ray tubes is solved by virtue of the material of the rotary anode or of the metal jet being transported sufficiently quickly through the focal spot at the focal point of the electron beam. In the process, the electrons are decelerated to a standstill, even though only high-energy electrons cause the desired short-wave x-ray radiation. In view of the focal spot power deposition, and also in view of the efficiency, the complete deceleration is a disadvantageous process.

SUMMARY AND DESCRIPTION

It is an object of the present embodiments to propose a metal jet x-ray tube that is affected less than conventional stationary or rotary anode tubes, or previous metal jet x-ray tubes, by the problem of the power density at the point of incidence of the electron beam on the anode component.

Accordingly, in a vacuum chamber, the metal jet x-ray tube includes a provision for causing the extraction of the electron beam from the cathode component in addition to a cathode component. Moreover, the metal jet x-ray tube includes an anode component formed by a liquid metal jet as a target for the emitted electron beam of the cathode component and a provision for accelerating the electron beam emitted by the cathode component within a vacuum path in the direction and with the target of the anode component. To the end, the metal jet x-ray tube includes a thin metal jet as an anode component, by which the electrons of the electron beam incident on the anode component are only partly decelerated. Furthermore, the metal jet of the anode component is embedded or else dissolved in a second material that passes electrons relatively well and is heat absorbing.

By way of example, the dissolution may be brought about in the form of an alloy or a mixture. In contrast to previous metal jet x-ray tubes, the dissolution enables physically relatively thick but electron-optically thin anodes with a large specific energy absorption capacity. Overall, the metal jet may have the easily realizable cylinder form with a diameter of the order of the electron beam diameter, e.g. 10 to 100 μm, but the metal jet may nevertheless have sufficient electron-kinetic transparency. The mixture or the alloy should have a low melting point in order to enable the liquid jet formation. The improved energy absorption capacity of the anode material reduces the necessary anode beam velocity and/or enables a higher power deposition and hence a higher luminance of the focal spot.

Overall, a metal jet x-ray tube is obtained that no longer has the disadvantages mentioned at the outset.

The fast primary electrons accelerated over a first vacuum path by electrostatic or electrodynamic means are only partially decelerated in a thin, relatively electron-transparent target medium.

However, a problem still existing here is that the thin light-generating anode material may only absorb very little energy. As a result, there initially is substantially the same power limit as in a thick anode material. Physically very thin anode materials are required, for example with a thickness of 0.1 to 10 μm.

Second, it is very difficult to realize a liquid metal jet with a form that differs from a round one. Hence, the focal spot diameter is likewise restricted to a very small dimension. Furthermore, the presence of a strong, homogeneous background magnetic field, for example in the case of use in a magnetic resonance imaging scanner, renders it impossible to electrostatically focus the electrons.

In order to solve this problem, the metal jet x-ray tube has a knife-edge cathode as a cathode component, with a cathode edge pointing with a slight downward inclination in the direction of the liquid metal jet of the anode component. The knife-edge cathode generates a planar electron beam with a thickness adapted to the metal jet diameter such that a sufficiently large portion of the electrons emerging from the cathode hit the metal jet.

It was furthermore found to be advantageous to have a further vacuum path downstream of the anode component for the not yet completely decelerated electrons of the electron beam, in which further vacuum path there is deceleration of the electrons, at least approximately to standstill.

If this decelerating of the electrons is carried out together with an energy recuperation provision, the light generation efficiency is increased in an advantageous manner.

The scope of the present invention is defined solely by the appended claims and is not affected to any degree by the statements within this summary. The present embodiments may obviate one or more of the drawbacks or limitations in the related art.

FIGURES

Figure 2:
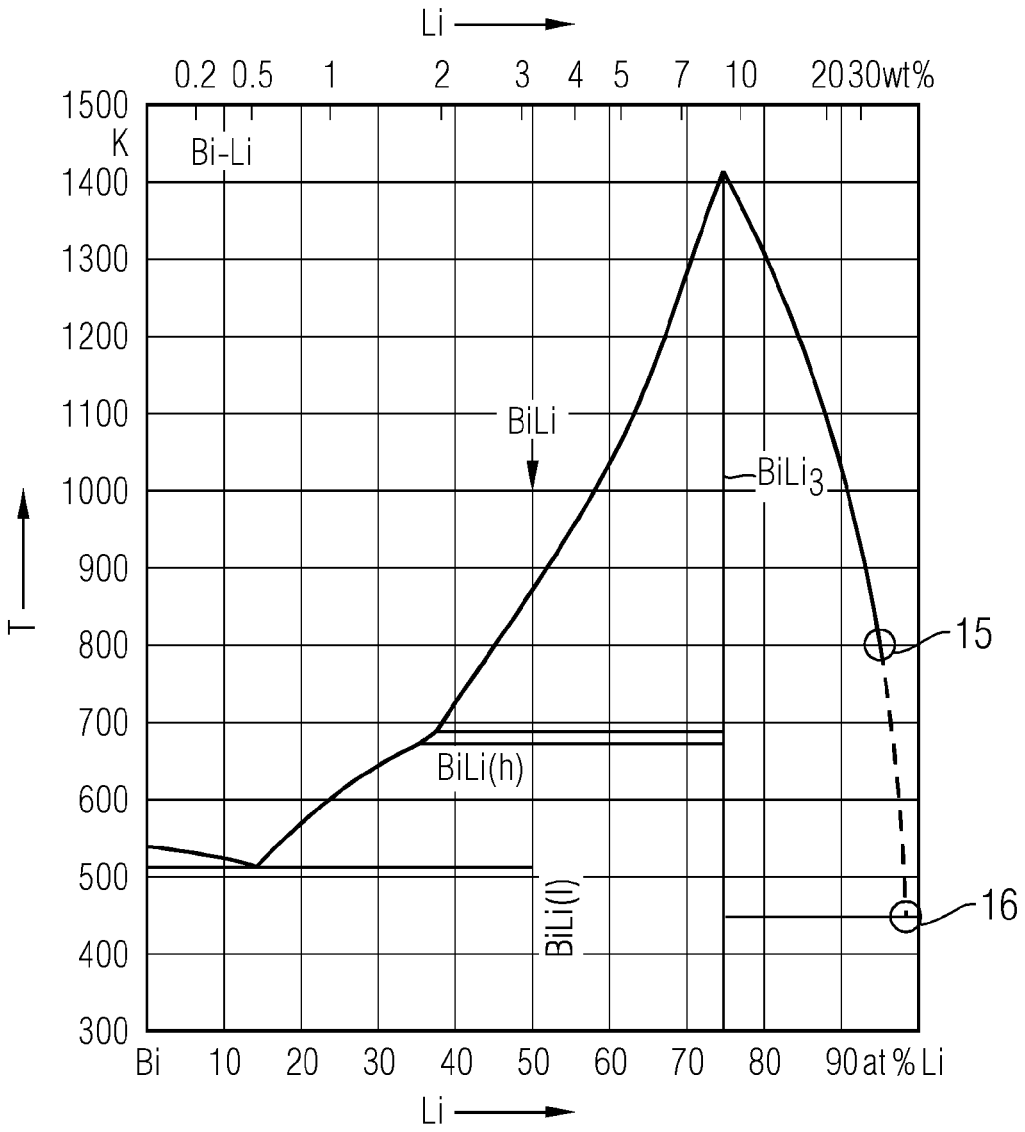

Some non-limiting examples of embodiments are described below with reference to the accompanying drawings, in that:

FIG. 1 depicts an illustration of the principle of a metal jet x-ray tube according to one embodiment and FIG. 2 depicts a graph in respect of a selected advantageous material combination for the formation of the metal jet of the metal jet x-ray tube according to one embodiment.

DETAILED DESCRIPTION

FIG. 1 depicts a metal jet x-ray tube 1 including a vacuum chamber 2. A cathode component 3 is arranged in the vacuum chamber 2. The cathode component 3 serves to extract an electron beam 4. Moreover, a provision 5 for causing the extraction of the electron beam 4 from the cathode component 3 is provided in the vacuum chamber 2. Furthermore, provision is made in the vacuum chamber 2 for an anode component 7 formed by a liquid metal jet 6. The metal jet 6 is the target for the emitted electron beam 4 of the cathode component 3. A provision 8 serves for accelerating the electron beam 4 emitted by the cathode component 3 in the direction and with the target of the anode component 7, at least within a vacuum path 9.

The metal jet 6 is realized as a thin metal jet, to the extent that the electrons of the electron beam 4 are only partly decelerated by the metal jet 6. The cathode component 3 has a cathode knife edge 10 such that the cathode component 3 may also be referred to as knife-edge cathode. The cathode knife edge 10 is aligned with a slight downward inclination in the direction of the liquid metal jet 6 of the anode component 7.

There is a further vacuum path 11 downstream of the anode component 7 for the electrons of the electron beam 4 that have not yet been decelerated completely. The vacuum path 11 serves to decelerate the only partly decelerated electrons downstream of the anode component 7 at least approximately to standstill. To this end, an embodiment in accordance with the figure additionally has an energy recuperation provision 12.

It is not specifically identifiable in the figure that the metal jet 6 of the anode component 7 is at least embedded or dissolved in a single second material 13 that passes electrons relatively well and is heat absorbing.

According to embodiments, use is made of a knife-edge cathode that is slightly inclined in relation to possibly present magnetic field lines. Additionally, in the exemplary embodiment according to the figure, use is made of an alloy or a mixture made of at least two components as an x-ray beam generating anode material and, furthermore, use is made of an energy recuperation provision 12 that captures the electron beam emerging from the metal jet 6 of the anode component 7 using an electrostatic collector. By way of example, as material 13 for the metal jet 6 of the anode component 7, use is made of a chemical element with an atomic number of 30 to 92, e.g. barium, lanthanum, cerium, bismuth, tungsten etc., and of at least one heat-absorbing component that is relatively transparent to electrons and x-rays, for example a chemical element with an atomic number <20, e.g. lithium.

The metal jet 6 is e.g. injected into the electron beam 4 by an injector such that bremsstrahlung and characteristic radiation are generated in the interaction zone 14. The transmitted and scattered electrons are decelerated in an electrostatic collector by way of a counteracting E-field with recuperation of energy and caught at a low velocity.

Easily melting metal alloys tend to have a high vapor pressure in the case of elevated temperatures, which promotes the deposition of conductive surface layers, e.g. on insulators. It is therefore advantageous to guide the metal jet 6 through the discharge chamber for only a minimum length required for the interaction with the electron beam 4 and thereafter let the metal jet 6 enter a wall-cooled condensation and collection container.

The graph shown in FIG. 2 is in respect of a selected advantageous material combination for the formation of the metal jet of the metal jet x-ray tube. What is shown, in particular, is the influence of temperature by different types of mixture ratios between bismuth (Bi) and lithium (Li) materials. Shown therein is, in particular, the point 15, which specifies the increase of the melting point when Li is lost (evaporation). In comparison therewith, point 16 is shown that specifies a temperature in respect of the initial alloy.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A metal jet x-ray tube in a vacuum chamber, the metal jet x-ray tube comprising:

a cathode component for extracting an electron beam;

a structure for causing the extraction of the electron beam from the cathode component;

an anode component formed by a liquid metal jet as a target for the emitted electron beam of the cathode component; and an electrical connection for accelerating the electron beam emitted by the cathode component within a vacuum path in the direction and with the target of the anode component, wherein the liquid metal jet forming the anode comprises a thin metal jet by which electrons of the electron beam incident thereon are only partly decelerated, and the thin metal jet is embedded, dissolved, or embedded and dissolved in a second material that passes electrons and is heat absorbing, and wherein a knife-edge cathode is provided as the cathode component, with a cathode edge pointing with a downward inclination in a direction of the liquid metal jet forming the anode component.

2. The metal jet x-ray tube of claim 1, wherein a further vacuum path is provided downstream of the anode component for the not yet completely decelerated electrons of the electron beam, within which further vacuum path the electrons are decelerated at least approximately to standstill.

3. The metal jet x-ray tube of claim 2, wherein the decelerating of the electrons at least approximately to standstill is connected with an energy recuperation.

4. The metal jet x-ray tube of claim 3, wherein a further vacuum path is provided downstream of the anode component for the not yet completely decelerated electrons of the electron beam, within which further vacuum path the electrons are decelerated at least approximately to standstill.

5. The metal jet x-ray tube of claim 4, wherein the decelerating of the electrons at least approximately to standstill is connected with an energy recuperation.

6. The metal jet x-ray tube of claim 5, wherein the metal jet is formed with at least one chemical element with an atomic number of 30 to 92.

7. The metal jet x-ray tube of claim 5, wherein the metal jet is formed with at least one chemical element with an atomic number of less than 20.

8. The metal jet x-ray tube of claim 5, wherein the metal jet is formed with at least one chemical element of the series:

barium, lanthanum, cerium, bismuth, tungsten and lithium.

9. The metal jet x-ray tube of claim 2, wherein a further vacuum path is provided downstream of the anode component for the not yet completely decelerated electrons of the electron beam, within which further vacuum path the electrons are decelerated at least approximately to standstill.

10. The metal jet x-ray tube of claim 9, wherein the decelerating of the electrons at least approximately to standstill is connected with an energy recuperation.

11. The metal jet x-ray tube of claim 9, wherein the metal jet is formed with at least one chemical element with an atomic number of 30 to 92.

12. The metal jet x-ray tube of claim 9, wherein the metal jet is formed with at least one chemical element with an atomic number of less than 20.

13. The metal jet x-ray tube of claim 2, wherein the metal jet is formed with at least one single chemical element with an atomic number of 30 to 92 and with at least one single chemical element with an atomic number of less than 20.

14. The metal jet x-ray tube of claim 13, wherein the metal jet is formed with at least one chemical element of the series: barium, lanthanum, cerium, bismuth, tungsten and lithium.

15. The metal jet x-ray tube of claim 1, wherein the metal jet is formed with at least one chemical element with an atomic number of 30 to 92.

16. The metal jet x-ray tube of claim 1, wherein the metal jet is formed with at least one chemical element with an atomic number of less than 20.

17. The metal jet x-ray tube of claim 1, wherein the metal jet is formed with at least one single chemical element with an atomic number of 30 to 92 and with at least one single chemical element with an atomic number of less than 20.

18. The metal jet x-ray tube of claim 1, wherein the metal jet is formed with at least one chemical element of the series: barium, lanthanum, cerium, bismuth, tungsten and lithium.

* * * * *